US009144261B2

(12) United States Patent
Leegate et al.

(10) Patent No.: US 9,144,261 B2
(45) Date of Patent: Sep. 29, 2015

(54) COMBINATION MARKER LIGHT AND INFRARED INTERROGATION DEVICE

(71) Applicants: Gary Leegate, Clearwater, FL (US); Marcia Baldwin, Clearwater, FL (US)

(72) Inventors: Gary Leegate, Clearwater, FL (US); Marcia Baldwin, Clearwater, FL (US)

(73) Assignee: ARCACHON HOLDINGS LLC, Clearwater, FL (US)

( * ) Notice: Subject to any disclaimer, the term of this patent is extended or adjusted under 35 U.S.C. 154(b) by 0 days.

(21) Appl. No.: 14/515,918

(22) Filed: Oct. 16, 2014

(65) Prior Publication Data

US 2015/0062886 A1 Mar. 5, 2015

(51) Int. Cl.
*F21V 21/084* (2006.01)
*A42B 3/04* (2006.01)

(52) U.S. Cl.
CPC ..... *A42B 3/044* (2013.01); *A42B 3/0433* (2013.01)

(58) Field of Classification Search
CPC ..... F21V 21/0816; F21V 33/0064; F21V 23/0492; F21V 33/0076
USPC ..... 362/103–120
See application file for complete search history.

(56) References Cited

U.S. PATENT DOCUMENTS

| | | | | |
|---|---|---|---|---|
| 4,195,328 | A | 3/1980 | Harris, Jr. | |
| 5,414,405 | A | 5/1995 | Hogg et al. | |
| 5,633,623 | A | 5/1997 | Campman | |
| 6,213,623 | B1 | 4/2001 | Campman | |
| 7,021,790 | B2 | 4/2006 | Parsons | |
| 7,023,004 | B2 | 4/2006 | Ford et al. | |
| 7,315,036 | B2 | 1/2008 | Ford et al. | |
| 7,505,279 | B2 | 3/2009 | Ohtaki et al. | |
| 7,722,205 | B2 | 5/2010 | Kim | |
| 7,831,150 | B2 | 11/2010 | Roes et al. | |
| 8,477,492 | B2 | 7/2013 | Rothkopf et al. | |
| 8,485,686 | B2 | 7/2013 | Swan et al. | |
| 8,534,861 | B2 | 9/2013 | Leegate et al. | |
| 8,573,797 | B2 | 11/2013 | Spartano et al. | |
| 8,672,504 | B2 * | 3/2014 | Kramer | 362/109 |
| 2008/0216699 | A1 * | 9/2008 | McAleer et al. | 362/112 |
| 2010/0128468 | A1 * | 5/2010 | Ong et al. | 362/106 |

FOREIGN PATENT DOCUMENTS

WO WO2009101391 A2 8/2009

* cited by examiner

*Primary Examiner* — William Carter
(74) *Attorney, Agent, or Firm* — Larson & Larson, P.A.; Frank Liebenow; Patrick Reid

(57) ABSTRACT

The device is a helmet-mounted or helmet-integrated combination personnel marker/identification light and active "Identification Friend or Foe" (IFF) infrared interrogation and response device. The IFF function provides acquisition and processing of an incoming IR laser IFF interrogation and then sends one or more user-defined responses to the interrogator and/or the user/wearer. A photo sensor array is designed to detect and identify incoming infrared signals. The array is arranged to provide omni-directional, line-of-sight sensing over more than a full hemisphere. A detachable user feedback module comprised of a vibratory pad and cable provides a user/wearer alert when infrared interrogation has been detected. An operating status switch allows the user/wearer to confirm that the device is in an active mode.

11 Claims, 7 Drawing Sheets

COMBINATION MARKER LIGHT AND INFRARED INTERROGATION DEVICE

BACKGROUND OF INVENTION

The present invention relates to a helmet-mounted or helmet-integrated combination marker light and active "Identification Friend or Foe" (IFF) infrared laser acquisition and response device.

The device is a combination helmet-mounted or helmet-integrated marker light and active "Identification Friend or Foe" (IFF) infrared acquisition and response device that provides acquisition and processing of an incoming infrared (IR) laser IFF interrogation and then sends one or more user-defined responses to either or both the interrogator and the user/wearer. The device combines multiple passive visible and infrared marking/emission capabilities (also referred herein as "functions") with the ability to acquire and recognize interrogation from remote infrared (IR) lasers (usually weapon or vehicle-mounted) and to provide automatic responses that provide both an infrared "I am friendly—do not shoot" signal to the interrogator and a tactile, visual or aural notification to the user/wearer that he/she has been interrogated. The marking/emission capability of the device is multi-mode and multi-functional with dual user-selectable operating modes and at least two user-selectable functions within each operating mode; the "IFF" capability of the device is user-defined to respond to user-selected, specific IR laser interrogation devices or other devices that provide means to interrogate with user-defined IR laser frequency, wavelength, and/or modulation characteristics.

It is an object of the invention to provide a photo sensor array to acquire and process incoming infrared laser signals from any line-of-sight direction and then to emit a response to that incoming signal that will communicate to the source of the incoming signal (the interrogator) that the invention is being worn by a "friendly" combatant.

It is another object of the invention to provide electronic means to alert the user/wearer of the invention with tactile, visual and/or aural signals that the device has received an incoming infrared laser interrogation signal.

It is another object of the invention to provide the user/wearer with an operating status check (OSC) switch to confirm that the device is in an active, already-operating mode including visible or infrared emission functions and/or IFF interrogation reception mode.

It is an another object of the invention to provide a low profile housing with a curved, minimally obstructive shape on all sides and edges to mount on helmets or other equipment or structures, and particularly to provide minimal snag potential or interference with objects that may be encountered during ground combat operations or parachuting, including interference with parachute lines and risers.

It is another object of the invention to provide the ability to select between two distinct and independent operating modes (e.g., overt and covert) with two or more discreet visible and/or infrared function profiles within each operating mode, and to effectively separate and segregate these independent sets of functions by two separate mechanical switching means.

It is another object of the invention to provide a variety of emitters to allow a user-defined selection of different functions in the visible and/or infrared spectrum.

It is another feature of the invention to (a) preclude snag-prone protuberances which otherwise might violate the curvilinear, dome-like shape of the exposed surfaces of the device and thus further reduce potential interference (snagging) on external objects which could cause injury to the user/wearer, and (b) provide an uninterrupted curvilinear, dome-like surface through which emitted light may radiate in substantially all directions defined by line-of-sight visual access to the invention in its mounted/installed condition.

It is another feature of the invention to be configured so as to facilitate secure, conformal mounting directly to the helmet or helmet cover through interfacing means such as mating hook and loop material (e.g., Velcro®), patches, self-adhesive features, or intermediate attachment means.

It is another feature of the invention to be configured so as to facilitate secure, conformal mounting to standard attachment means built onto the helmet structure (e.g., Picatinny rails) via intermediate security means.

It is another feature of the invention to be configured as a purpose-built modular device designed to interface with attachment/interface features integrated directly into the helmet structure and specifically designed to secure the invention to the helmet.

SUMMARY OF THE INVENTION

The general purpose of the present invention, which will be described subsequently in greater detail, is to provide a multi-mode, multi-function marker/signaling device for steady and flash-coded identification in the visible and/or infrared spectrum, and to provide a photosensor array to acquire incoming infrared laser interrogation, and to provide an electronic means to process and interpret incoming infrared laser interrogation, and to emit a user-specified infrared response in the same or different wavelength in accordance with user-specified interrogation processing and response criteria.

To attain this, the present invention comprises a lens/cover formed of material permitting the passage of light, having first switch means comprising a three-position main/function switch and second switch means comprising a two-position operating mode switch separately disposed on the lens/cover. The material may be clear, tinted or translucent, making the cover clear or translucent is necessary to give omni-directional emission. A base is secured to the lens/cover by attachment means such as screws, ultrasonic welding, or sealing adhesives. An O-ring or other seal provides waterproofing and dust proofing for the space housing the electronics and captured between the lens/cover and the base.

An electronic circuit board having a first switch circuit and a second switch circuit (the second switch electronics is mounted on the main board) is mounted within the waterproof space defined by the cover and base. The main/function switch is mounted within a first (main) switch means cavity of the lens/cover and the operating mode switch is mounted within a second (operating mode) switch means cavity of the lens/cover.

A main electronic circuit board having a first switch circuit and a second switch circuit is mounted within the waterproof space defined by the lens/cover and base. The main/function switch and the operating mode switch are in electronic communication with the electronic circuit board and the corresponding switch circuits.

A variety of light emitting diodes (LEDs) and/or infrared (IR) emitters are mounted on the electronic circuit board. The LEDs and emitters can be multi-colored, white, or any infrared (IR) spectrum. The switch means are capable of being set to different positions to interact with the programmable circuitry on the electronic circuit board in order to actuate a different combination of visible or infrared (IR) functions, depending on the pre-programmed settings.

A primary (non-rechargeable) or secondary (rechargeable) battery provides the power source. A battery containment compartment comprises an integral part of the base or lens/cover with access to that compartment arrayed so as to be accessible for battery replacement in the field. A sealing battery cover secures and protects the battery within the containment compartment.

A photosensor array designed to detect and identify incoming infrared laser signals is connected to the main electronic circuit board and is positioned within the waterproof space defined by the lens/cover and base. The array is arranged to provide omni-directional, line-of-sight sensing over at least the full hemisphere defined by the base plane of the intersection of the lens/cover and base.

An electronic circuit which processes IR laser inputs to the photosensor array, determines whether or not those inputs have originated from a user-specified IR laser interrogation device and, if so, then causes the IR emitters in the invention to emit a user-specified signal in the same or different wavelength that can be "seen" directly by a human interrogator equipped with night optical equipment or by other sensing means or equipment capable of identifying the source of the emitted response signal as a "friendly" asset.

A detachable user feedback module (UFM) comprising a feedback means at one end (e.g., vibratory/tactile, aural, light emitting/fiber optic), an intervening cable, and a connector to the invention that communicates with the electronics and sensor array in a manner so as to provide a user/wearer alert when infrared laser interrogation has been detected.

An operating status check (OSC) switch allows the user/wearer to confirm, on demand, that the device is in an active mode (e.g., emitting/operating as a marker, and/or in an IFF "stand-by-ready-to-receive" mode).

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
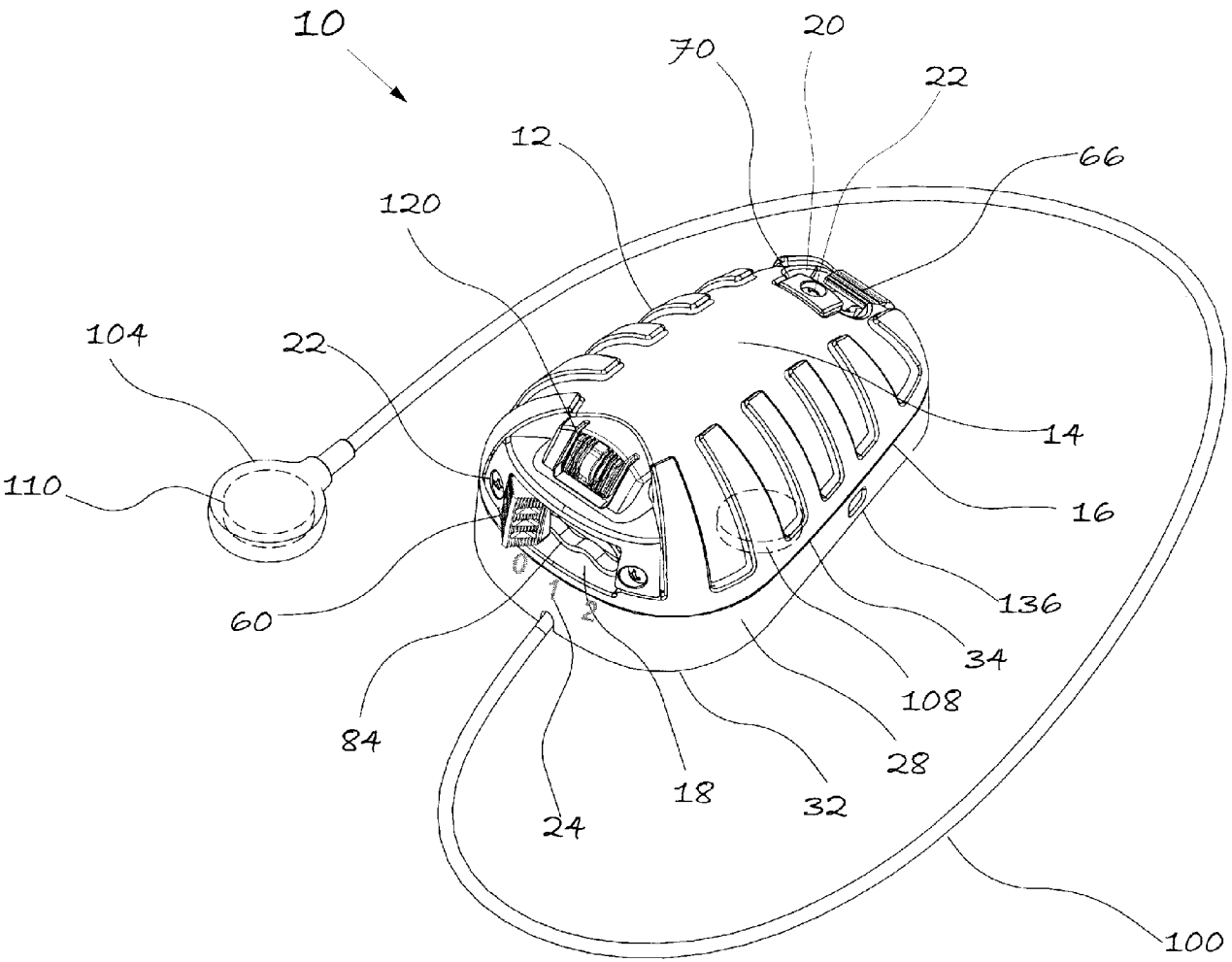
FIG. 1 is a rear oblique view of the present invention.
Figure 2:
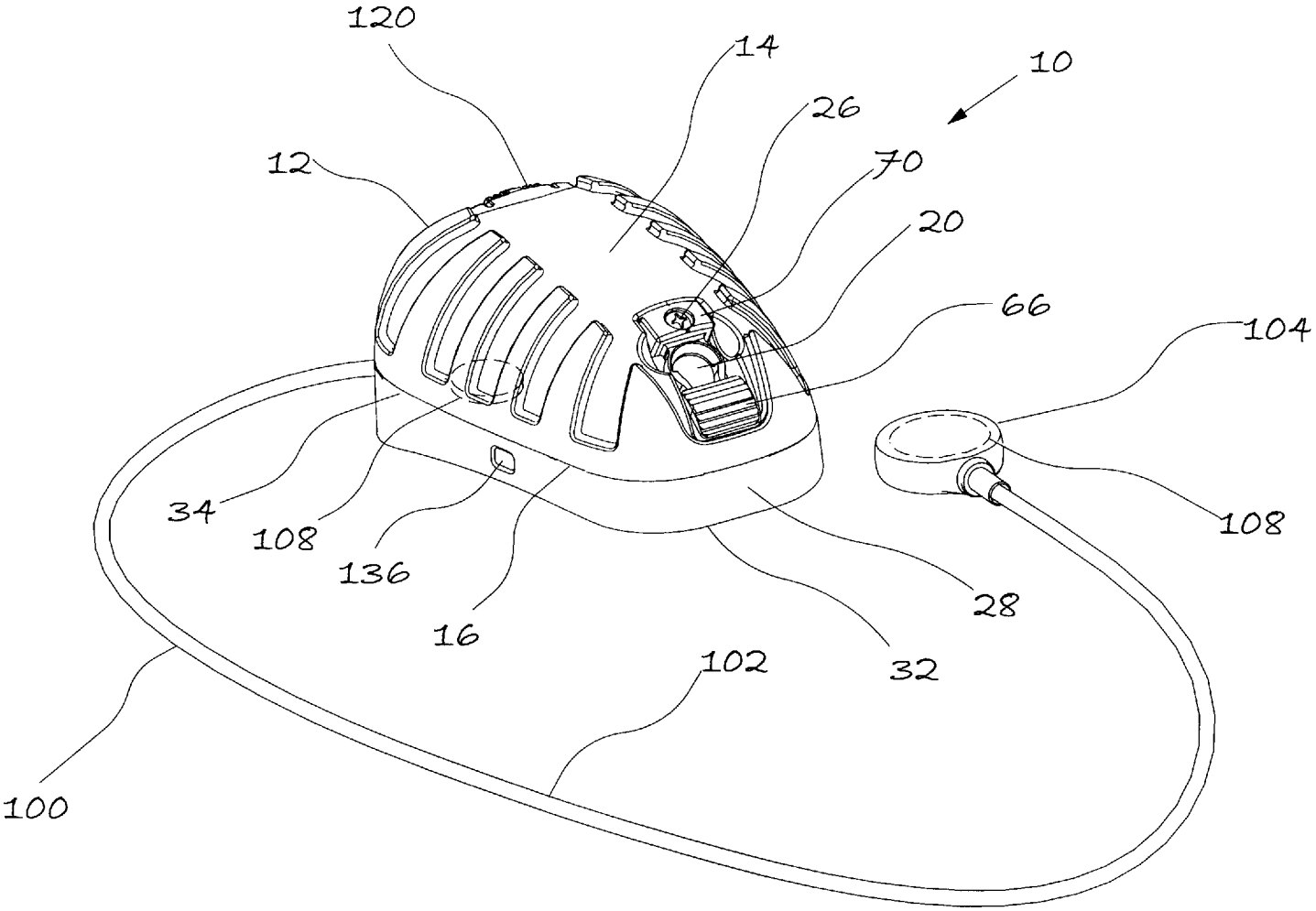
FIG. 2 is a front oblique view of the present invention.
Figure 4:
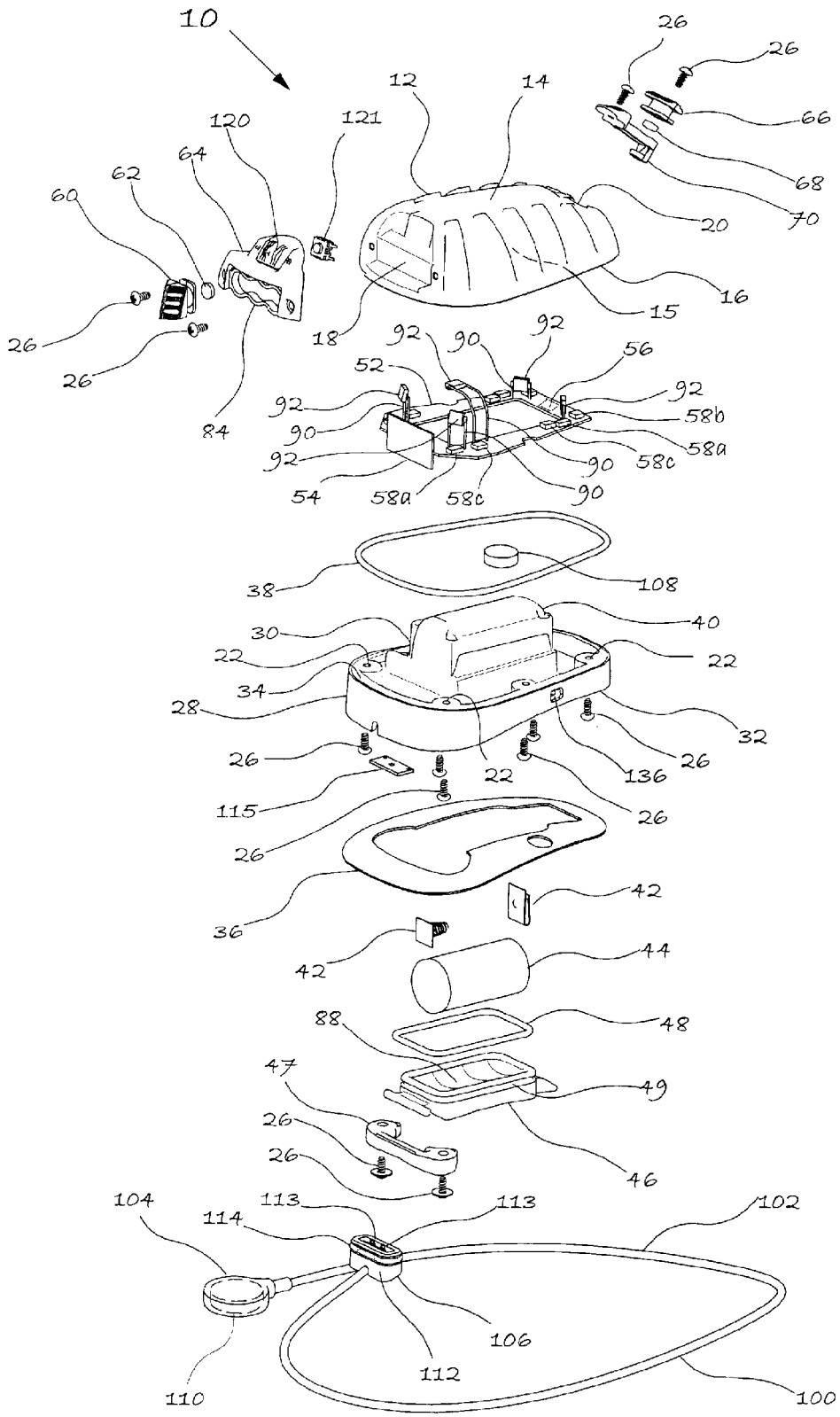
FIG. 4 is an exploded view of the present invention.

The present invention 10 will now be described in greater detail. Referring to FIGS. 1, 2, and 4, a lens/cover 12 formed of material permitting the passage of light is comprised of an outer surface portion 14, an inner surface portion 15 and a sealing surface 16. The material may be clear, tinted or translucent. The outer surface portion 14 has a first (main/function) switch means cavity 18 defined at a first position and a second (operating mode) switch means cavity 20 defined at a second position. The lens/cover 12 is generally dome-shaped in all cross sections and is of compact size. The conforming shape on all sides provides for minimal snag hazard to avoid personal injury during ground combat and parachute operations. The sealing surface 16 of the lens/cover 12 has bores 22 that are inwardly disposed around its periphery. Numerical indicia 24 (e.g., "0", "1", "2") indicating switch positions are affixed to the invention 10 adjacent to the first and/or second switch in such a manner as to be identifiable for training purposes. It is understood that the relative orientation of the first switch means and the second switch means may be perpendicular, as shown in the figures, or parallel or otherwise located (e.g., on the sides) in such a way as to provide separate, unambiguous locations to allow the trained user to easily distinguish their respective functions.

Figure 5:
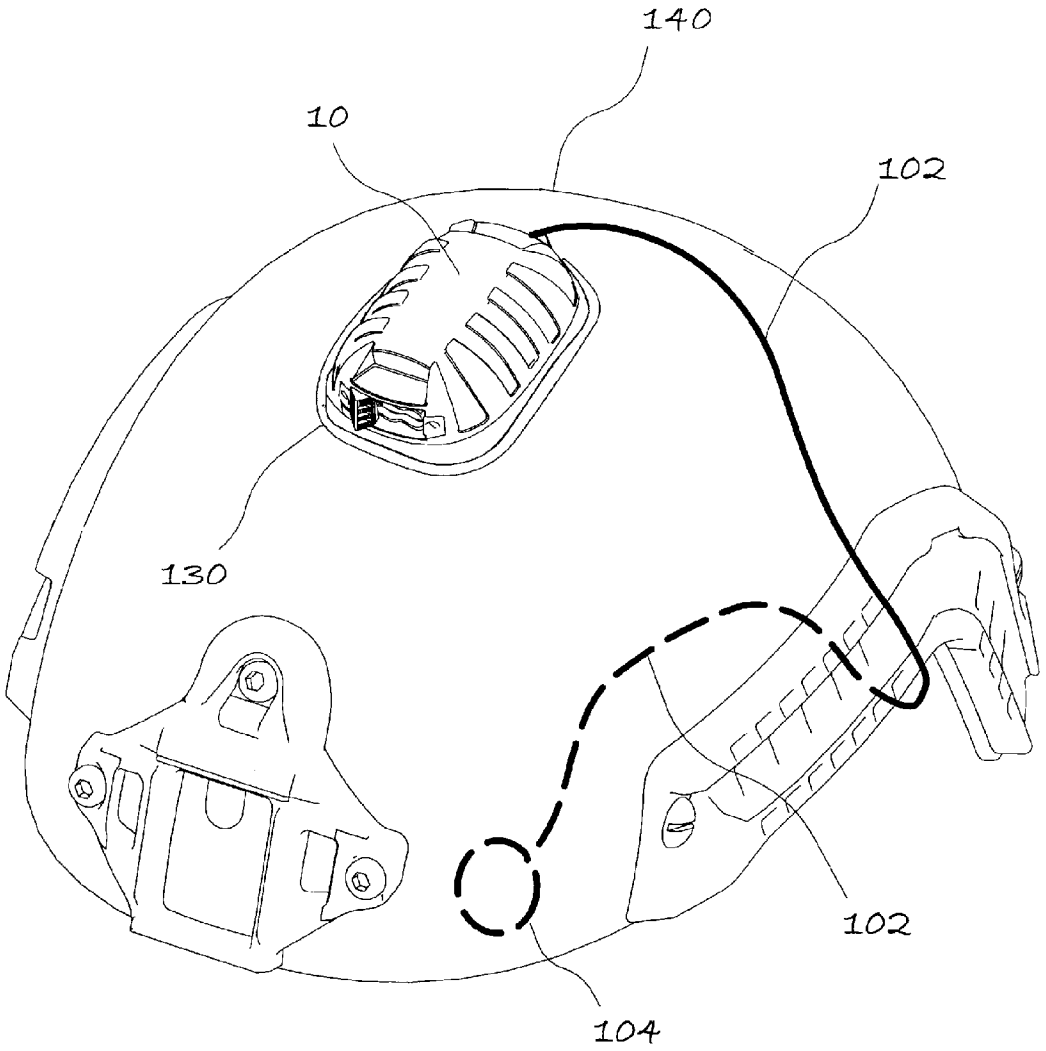
FIG. 5 is a view of the device in use temporarily attached to the top of a helmet via hook and loop type materials and illustrating the position of a vibratory pad of the user feedback means (UFM) positioned inside the helmet.
Figure 6:
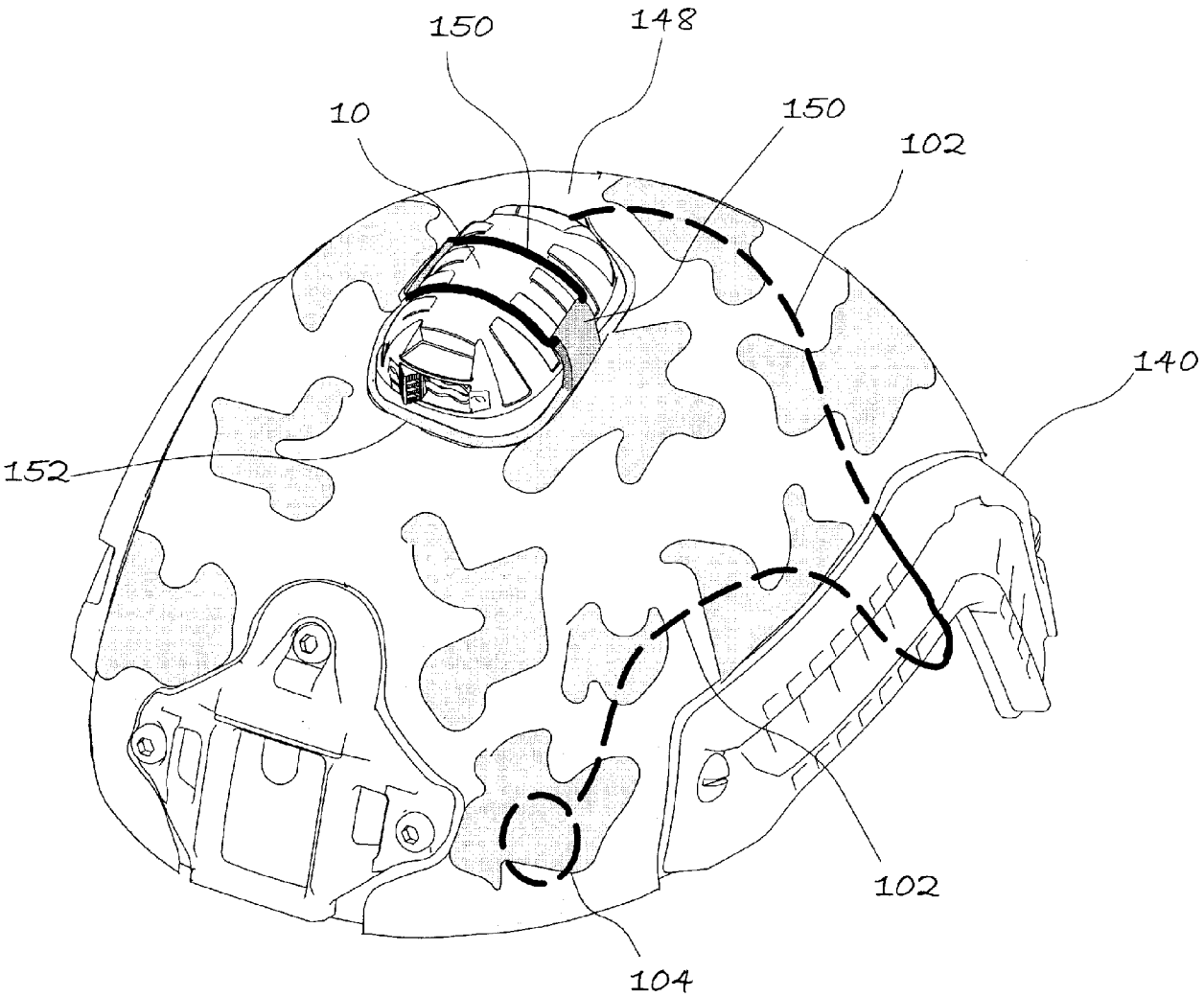
FIG. 6 is a view of the device in use mounted to a fabric cover of a helmet via an intermediate, secure attachment means affixed to the fabric cover.
Figure 7:
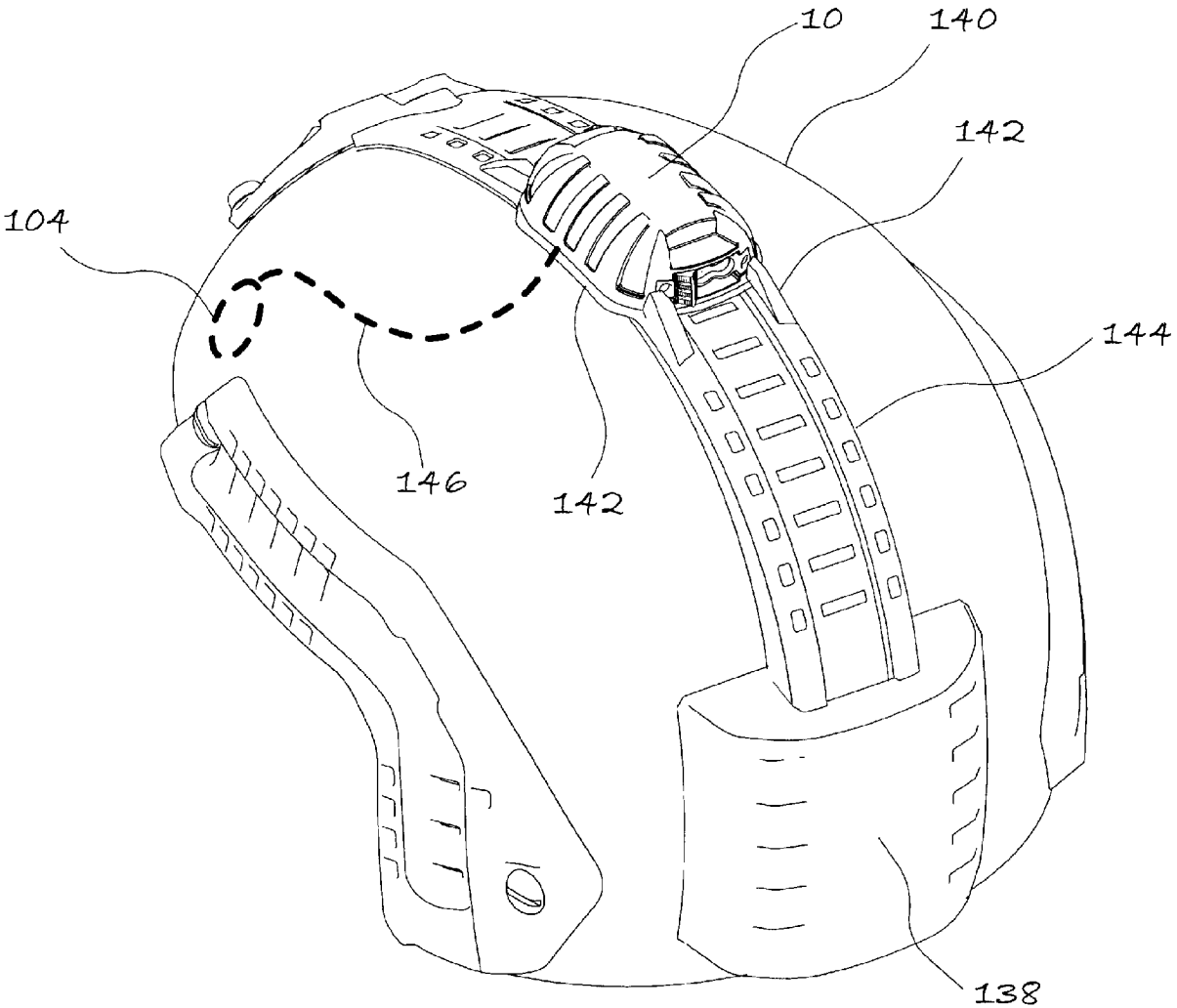
FIG. 7 is a view of the device in use mechanically and securely attached to the top of a helmet via a purpose-built, helmet-integrated attachment and interconnection means to a remote, integrated battery source and feedback means.

Referring to FIG. 4, a base 28 is comprised of an upper surface 30, a lower surface 32, and a sealing surface 34 having bores 22 that are inwardly defined through the upper surface 30 and the lower surface 32 and disposed so as to coincide directly with the bores 22 similarly disposed on the sealing surface 16 of the lens/cover 12. The lower surface 32 of the base 28 is preferably arcuate in shape to conform to the configuration of headgear, such as a military or parachute helmet. However, the lower surface 32 may be flattened to mount on other surfaces. Fastening means 36, such as hook and loop material (e.g., Velcro®), is present on the lower surface 32 to secure the invention 10 to a helmet and the like. As further illustrated in FIG. 3 a loss-prevention measure is provided. The base 28 further has an opening 132 defining a bore 136 therethrough extending from the bottom surface of the base 28 through a side surface of the base 28. This feature allows a cord, knotted at one end to be inserted, free end first, into the opening 132 and through the bore 136 so as to provide for a security tie-off of the device 10 to any available helmet structure. FIGS. 5-7 illustrate the invention 10 mounted on a helmet.

Referring to FIG. 4, a seal 38, preferably formed of a flexible rubber or rubber-like material to provide hermetic sealing, is mounted to and extends around the sealing surface 34. The sealing surface 16 of the lens/cover 12 is mounted onto the sealing surface 34 of the base 28 with the seal 38 intervening between the sealing surfaces 16 and 34. The lens/cover 12 and the base 28 are then secured with attachment screws 26 extending through bores 22 in lens/cover 12 and the base 28, and further defining a sealed cavity between them.

Figure 3:
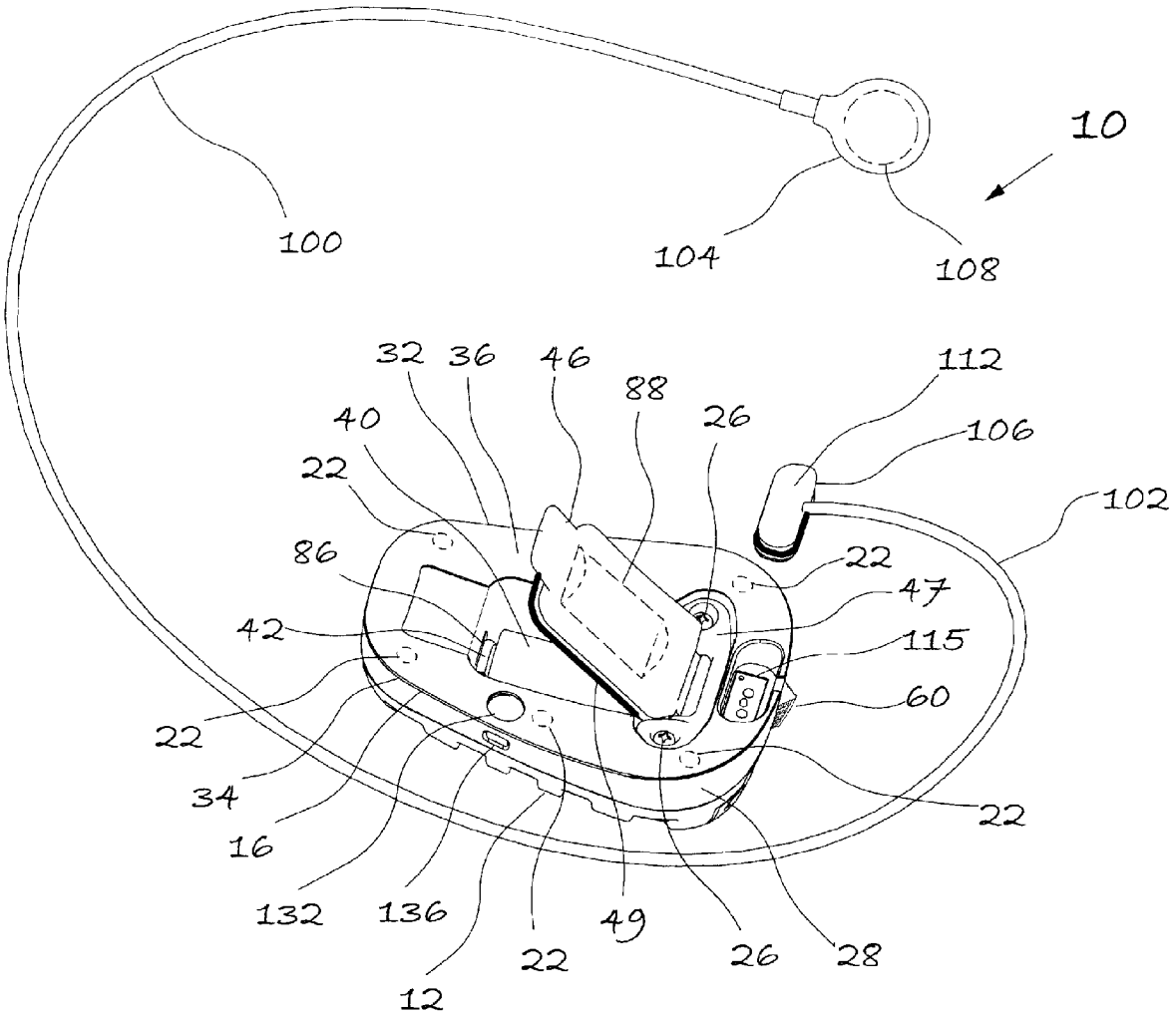
FIG. 3 is a bottom oblique view of the present invention with the user feedback means (UFM) disconnected.

Referring to FIGS. 3 and 4, a battery containment compartment 40 having an outer surface and an inner surface with an open cavity defined by the inner surface may be integrally formed on the upper surface 30 of the base 28. The compartment 40 is of predetermined size to accept rechargeable or non-rechargeable batteries. Battery contacts 42 are affixed on the inner surface of the battery containment compartment 40 and in electrical communication with the electronic circuit board 52 through slots 86 at each end of the battery containment compartment. A battery 44 is a power source for the invention 10. Slots 86 translating between the inner and outer surface of the battery containment compartment 40 are provided for the installation of the battery contacts 42. The slots 86 are filled and covered with sealant to provide waterproof and dustproof sealing of the battery contacts 42 as installed in the slots 86.

Referring to FIG. 7, in another embodiment, the power source 138 could be remote from and not an integral part of the invention 10. In such case, battery containment features would not be required to be a part of invention 10, but a helmet-integrated retention means 142 and electrical connection between the invention and the remote battery pack via a helmet-integrated connectivity means 144 built into or bolted onto the helmet would be required.

Referring to the embodiment illustrated in FIGS. 3 and 4, battery replacement is accomplished by opening a battery cover 46 mounted to the lower surface 32 of the base 28 via a battery cover retainer 47 and attachment screws 26. The battery cover 46 is preferably molded of a material similar to the base 28 and has a sealing surface 48 formed to accept a seal 49, preferably formed of a flexible rubber or rubber-like material to provide hermetic sealing between the battery containment compartment 40 and the battery cover 46. The battery cover 46 has a recess 88 formed therein to interface with the shape of the battery 44 to assist in retention, sealing, and space minimization. By placing battery replacement through the passage of the base 28, the battery 44 is secured within the mounting interface between the invention 10 and the structure, such as a helmet, upon which the invention 10 is mounted. This method of battery installation and replacement is novel in comparison to other helmet mounted devices. The battery cover 46 provides hermetic sealing against air, moisture, and dust. An alternate approach is to have the battery containment compartment and battery cover disposed on the lens/cover of the invention so as to allow for battery replacement without removing the invention from its mounted position on the helmet.

Referring to FIG. 4, an electronic circuit board 52 comprising electronic components, sensors/receptors, circuits, a processor and a memory coupled to the processor is disposed on the upper surface 30 of the base 28 and positioned within and captured by the surfaces defining the open cavity of the lens/cover 12 and the base 28 and the upper projection of the battery containment compartment 40. The electronic circuit board 52 is electronically coupled with the battery 44. The electronic circuit board 52 has a first (main/function) switch means circuit board 54 attached thereto and a second (operating mode) switch circuit portion 56 disposed thereon. The electronic circuit board 52 provides multi-function, multi-emission, multi-mode features, and includes a built-in programmable integrated circuit (PIC). Steady illuminated and various flashing functions can be programmed with variable oscillation patterns, variable intensity, and variable sequencing to provide appropriate intensity/visual acuity and/or coded or information-contained pulses.

Referring to FIGS. 1 and 4, a sliding main/function switch 60 coupled with a small disc magnet 62 is mounted within a main/function switch retainer 64 defining a series of two or three split capture rings 84. The main/function switch 60 interacts with electronic reed switches (not shown) disposed within the lens/cover 12, upon the first (main/function) switch means circuit board portion 54. Electronic reed switches are well known and not described here. The sliding main/function switch 60 is in electronic communication with the main switch board 52 via the first (main/function) switch means circuit board 54. A mechanical detent is defined for each position of the sliding main/function switch 60 by the split capture rings 84. Thus an appropriate level of hoop stress is allowed to solidly capture the sliding main/function switch 60 in each split capture ring 84 and to provide an appropriate level of resistance when moving from one split capture ring 84 position to the other. The main/function switch retainer 64 is secured juxtaposed the first (main) switch means cavity 18 with attachment screws 26. The sliding main switch can be positioned in OFF (Function "0") and two selectable operating modes (Functions "1" and "2"). The sliding main/function switch 60 can thus be ergonomically actuated by the user's thumb, in low/no light intensity situations, and in the same manner the ON/OFF status of the device and/or its precise operating function can be determined by tactile feel while the invention 10 is mounted on a helmet (as shown in FIGS. 5-7).

Referring to FIGS. 1, 2 and 4, a sliding operating mode switch 66 coupled with a built-in disc magnet 68 is mounted within a operating mode switch retainer 70. The retainer 70 is secured within the second (operating mode) switch means cavity 20 of the outer surface portion 14 of the lens/cover 12 with attachment screws 26. The magnet 68 interacts or fails to interact with an electronic reed switch (not shown) disposed within the lens/cover 12 upon the electronic circuit board 52 via the second (operating mode) switch board portion 56. The sliding operating mode switch 66 is in electronic communication with the operating mode switch circuit disposed on the circuit board portion 56. The sliding operating mode switch 66 provides the user the ability to select one of two distinct operating modes, e.g., Mode A (such as overt or visible) or Mode B (such as covert or infrared), depending on the particular embodiment of the invention.

Referring to FIG. 4, a plurality of emission sources 58*a*, 58*b*, 58*c* comprised of a variety of types and colors of LED and infrared emitters are disposed on the electronic circuit board 52 and are in electrical communication with the electronic circuit board 52. The features can be combined and/or manipulated in ways to provide at least four different user-defined and selectable functions based on any visible or infrared emission or combination of emissions that can be generated by multiple Red/Green/Blue (RGB) three-chip LEDs 58*a*, multiple high-intensity "white" light LEDs 58*b*, and multiple infrared (IR) emitters and/or LEDs 58*c* which may emit in one or more different wavelengths.

Any of the emitter sources 58*a*, 58*b*, 58*c* can be operated at the same time individually or in tandem with other emitter sources, each in either flashing or steady ON. For example, in one operating mode four RGB light sources 58*a* are operating in constant Green/Steady while two high intensity white light sources 58*b* are operating intermittently in a flashing mode. Furthermore the electronic circuit board 52 can be programmed to allow the emitter sources 58*a*, 58*b*, 58*c* mounted at one end of the electronic circuit board 52 to be set in different color/intermittent/steady modes from the light sources 58*a*, 58*b*, 58*c* at the opposed end of the electronic circuit board 52.

The multi-function, multi-emission, multi-mode features of the invention 10 are facilitated by a programmable integrated circuit (PIC) located on the electronic circuit board 52. The steady ON and flashing functions can be programmed with variable oscillation patterns and peaks and sequencing to provide increased intensity/visual acuity and/or coded or information-containing pulses. The battery 44 outputs to the emitter sources 58*a*, 58*b*, 58*c* are controlled by the electronic circuit board 52 having programmable integrated circuits. Voltage regulator devices and/or circuits are added to the electronic circuit board 52 to match emitter input requirements and/or to achieve optimized output for specific mission requirements.

The general configuration of the device incorporates the sliding main/function switch 60 and the sliding operating mode switch 66 and provides a minimum of four functions. There are a total of two modes of operation (e.g., Mode A and Mode B), with a minimum of two functions (Function "1" and Function "2") in each operating mode. The sliding main/function switch 60 is either in the OFF (Function "0") or ON (Function "1" or Function "2") position. The two-position sliding operating mode switch 66 can be either in Mode A or Mode B. Furthermore, the electronic circuit board of the device has the ability to re-program the function or mode of operation by cycling the main/function switch through a pre-established pattern of movements among main/function switch positions "0," "1," or "2." The integral programmable integrated circuit (PIC) would detect these switch movements as powering ON and OFF through a pre-programmed code which, when detected by the PIC, would initiate a routine which would result in a change to a function or an operating mode.

Referring to FIG. 4, the device is equipped with an active "Identification Friend or Foe" (IFF) acquisition, response and feedback system which reacts to interrogation from a remote IR laser source. The IR acquisition means 90 comprises multiple photosensors 92 affixed and arrayed within the cavity defined by lens/cover 12 and base 28 and in electrical communication with the electronic circuit board 52. The shape of the lens/cover 12 and the array of photosensors 92 are configured to provide omni-directional sensing of an IR laser interrogator that has line-of-sight access to the invention thereby providing more than a full hemisphere defined by line-of-sight visual access to the invention in its mounted/installed condition.

Specific infrared emissions (wavelengths and modulations and/or codes) from the infrared LEDs 58*c* are programmed to respond to user-specified military infrared laser devices or other sources with user-specified combinations of power level, wavelength, frequency, and modulation. The wavelength of response emissions may be different from the incoming interrogation lasers. Once a remotely generated infrared laser signal is detected by the photosensor array, the signal is processed by on-board electronics to determine if the incoming signal meets the pre-determined requirements for response. If so, the on-board electronics signals the device 10 to respond per user-defined specifications—both to the interrogator as an indication that the user/wearer is "friendly" and to the user/wearer as an alert that a laser interrogation has occurred.

If the on-board electronics recognizes the incoming infrared laser signal as meeting the user-defined criteria to deliver a response, the on-board electronics signals the device within microseconds to emit a user-specified infrared emission, emission/pulse or emission/pulse pattern that can be seen by the interrogator. This IFF response emission can use the same infrared emitters that are used in the standard operating functions or other emitters/wavelengths selected specifically for the IFF response. The IFF response will override standard marking emissions (from the infrared emitters as well as the other spectrum emitters) to provide a unique, unambiguous signal that can identity the user/wearer as a "friendly" force to the interrogator. The interrogator is usually a combatant with a weapon or vehicle-mounted IR laser interrogator/illuminator device or an aircrew member in an aircraft in flight, equipped with such a device. The combatant or aircrew member is looking at the user/wearer "target" through infrared-sensitive night optical equipment.

There are three activity states of operation for the device 10: ON, OFF/STANDBY, and OFF/SLEEP. In the first two states (ON and OFF/STANDBY), the IFF features are in "stand-by, ready-to-receive and respond" mode. In the third state of operation (OFF/SLEEP) all features including IFF are deactivated. In the ON state, the main/function switch 60 is in either Function "1" or "2" and is emitting in one of the four user-defined operating functions, and the IFF functions are in a "stand-by, ready-to-receive and respond" mode. In the OFF/STANDBY activity state, the main/function switch 60 is off and the IFF features are in a "stand-by, ready-to-receive and respond" mode. In the OFF/SLEEP activity state, the main/function switch 60 is off (Function "0") and the IFF acquisition/response features are deactivated. The device will not respond to IR laser interrogation in the OFF/SLEEP activity state.

Upon receipt immediate response to the infrared laser interrogation by the invention, the interrogator can, with confidence, identify the user/wearer of the device as a "friendly" and make the decision not to engage the target. This response feature is usually ON at all times, except when the device 10 has been deliberately placed in an OFF/SLEEP mode (e.g., in cases where a specific mission profile requires that forward operators be 100% "lights-out"). The device is automatically changed from the OFF/SLEEP mode to one of the other two active states whenever either or both of the switch means are moved from their current position, as defined by the user.

If on-board electronics recognize an incoming infrared laser as meeting the user-defined criteria to a deliver a response, user feedback means 100 generates an alert signal to the user/wearer. The alert signal may be tactile with a vibrating motor, visual with a remote emitter electronically connected to the device 10 or aural with an independent electronic component which emits a sound that can be heard by the user. As shown in FIGS. 1-4, the feedback means in this embodiment 100 comprises an electrical or fiber optic cable 102 having a vibratory pad 104 with an embedded vibratory motor affixed at a first distal end and connection means 106 affixed at a second proximal end. The base 28 has a cavity 33 defined therein to accept the connection means 106. Electrical contacts 115 are integrally formed and positioned medially within the cavity 33 of the base 28. The connection means 106 comprises a male plug 112 having sealing features 114 on the engagement surface. Complimentary spring-loaded electrical contact protrusions 113 extend from the plug 112 to securely mate with the electrical contacts 115 embedded in the base. The connection means 106 is securely retained within the cavity 33. When interrogation meeting user-defined characteristics has occurred the vibratory motor is activated providing a tactile alert to the user/wearer that such interrogation has occurred. The feedback means 100 may be interfaced to the base 28 via the connection means 106 or alternately may be hard wired directly into the base 28 without intervening connectors. The cable 102 is routed to the interior of a helmet and the vibratory pad 104 is mounted within the helmet in such a manner as to ensure that the user/wearer will feel the vibration.

Referring to FIG. 7, an alternate approach is to have the feedback means 104 integrated directly into a helmet 140 and connected to the invention via wires 146 and contacts also integrated into the helmet-integrated retention and connectivity means 142 and/or 144.

A tactile signal to the user/wearer of the device 10 that a specified military infrared laser interrogation has occurred is also provided by one or more vibration motors in the vibratory pad 104 or the vibratory motor 108 embedded in base 28 and in electrical communication with the electronic circuit board 52. Tactile vibration can be felt by the user/wearer via the vibratory pad 104 located within the helmet, or through vibrations imparted to the helmet through the vibratory motor 108 embedded in base 28.

As illustrated in FIGS. 1 and 4, an operating status check (OSC) switch 120 in electrical communication with on-board electronics via a small tactile switch 121 is aligned adjacent the main/function switch 60 and activates one or more of the vibratory motor 108 in base 28 or the vibrator motor 110 in vibratory pad 104 to signal the user/wearer as to activity state or operation of the device 10 on demand. By momentarily pressing the switch 120, the user will ascertain whether or not the IFF functions are active relative to an IR laser/IFF interrogation. If there is no vibration from either vibratory source then the device 10 is in OFF/SLEEP and the IFF functions are inactive. If either or both the vibratory motor 108 embedded in the base 28 or the vibratory pad 104 activate, the device 10 is in an IFF "stand-by, ready to receive and respond" mode (e.g., either ON or OFF/STANDBY). The OSC switch 120 and the vibratory feedback that it provides functions only in an "on demand" mode to provide feedback to the user/wearer that a prescribed functionality is either ON (Function "1" or "2") or OFF (Function "0"), and does not automatically or otherwise signal a transition from OFF or ON or any change of operating state or emission spectrum.

A second option of the OSC switch 120 is to confirm the operational status of the device 10 relative to functions in a standard operating mode (ON or OFF). Two separate feedback methods, one in the vibratory pad 104 in the feedback means 100 and the other in the vibratory motor 108 embedded in the base 28 are provided. If the OSC switch 120 is pressed and there is no vibration from either the vibratory motor 110 in the vibratory pad 104 or the vibratory motor 108 embedded in base 28 the device is in either the OFF/SLEEP or OFF/STANDBY mode and the invention 10 is not emitting in a standard operating mode. In one embodiment, the OSC switch 120 is pressed and there is vibration imparted to the hand pressing the OSC switch 120 from the vibratory motor 108 in the base 28, then the device 10 is emitting in a standard operating mode A third option of the OSC switch 120 is to confirm both the status of the IFF function (SLEEP or STANDBY) and the operational status (ON or OFF). Two separate feedback methods, one the vibratory pad 104 in the feedback means 100 and the other the vibratory motor 108 embedded in the base 28 are provided. If the OSC switch 120 is pressed and there is no vibration from either the vibratory pad 104 or the vibratory motor 108 the device is in OFF/SLEEP mode and the invention 10 is disabled with respect to the IR laser/IFF interrogation and is not emitting in a standard operating mode. If the OSC switch 120 is pressed and there is vibration from the vibratory pad 104 only, then IFF functions are enabled and the device 10 is not emitting in a standard operating mode. If there is vibration feedback from both the vibratory pad 104 and the vibratory motor 108 after the OSC switch 120 is pressed, then the IFF functions are enabled and the device 10 is in a standard operating mode. If there is tactile vibration from the vibratory motor 108 only, then the IFF functions are enabled, the device 10 is in a standard operating mode, but the vibratory pad 104 in feedback means 100 has been removed or is inoperable.

At any time during a mission, the user of the device 10 can verify the IFF is in the active mode by pressing the OSC switch 120.

The electronic components disposed within the lens/cover 12 and base 28 and upon the electronic circuit board portions 52, 54, and 56 are protected by the O-ring seal 38 or other sealing method such as ultrasonic welding to prevent moisture and dust intrusion. If attachment is made by mechanical means such as screws 26, they would be installed with either O-rings or other compounds with sealant qualities.

As illustrated in FIGS. 5, 6, and 7, the device 10 is mounted on a helmet 140. In FIG. 5, the invention is mounted directly on the helmet 140 via a self-adhesive loop material patch 130 affixed to the helmet which interfaces directly with the mating hook material 36 affixed to base 28 of the invention 10. The cable 102 of user feedback means 100 is routed from the device 10 over the outer surface of the helmet 140 and then into the interior of the helmet so as to locate the user feedback vibratory pad 104 to a position close to the user/wearer's head to maximize vibratory feedback. In FIG. 6, the device 10 is attached to a fabric helmet covering 148 on the helmet via an intermediate bungee attachment device 150 affixed to the fabric covering 148. The cable 102 of user feedback means 100 is routed from the device 10 under the fabric helmet covering 148 and then into the interior of the helmet so as to locate the user feedback vibratory pad 104 to a position close to the user/wearer's head to maximize vibratory feedback. In FIG. 7, the device 10, in this embodiment, does not have an integral battery source 44, but is mounted to purpose-built, helmet-integrated retention and connectivity means 142, 144 which communicates with a helmet-mounted/integrated remote power source 138. In this embodiment, the vibratory pad 104 is integrated into the helmet and connected to the device 10 by helmet-integral wiring 146.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description only and should not be regarded as limiting the scope and intent of the invention.

We claim:

1. A mountable marker light and infrared laser interrogation response device, comprising in combination:

a cover formed of material permitting passage of light having an outer surface portion;

a base having an upper surface, a lower surface, a top perimeter edge and fastening means affixed to the lower surface;

an electronic circuit board;

a first switching means for selectively choosing function positions mounted to the cover and being in electrical communication with the electronic circuit board;

a second switching means for selectively choosing operating modes mounted to the cover and being in electrical communication with the electronic circuit board;

at least one emitter source mounted on the electronic circuit board and being in electrical communication with the electronic circuit board;

infrared signal acquisition means for receiving incoming infrared laser transmission signals;

electronic means to process/interpret acquired incoming infrared laser transmission signals;

electronic means to automatically cause at least one emitter source mounted on the circuit board to actively respond to an acquired, processed incoming infrared laser transmission signals in the same or different wavelength;

a battery as a power source being in communication with the electronic circuit; and a feedback means in electrical communication with the infrared signal acquisition means, whereby the feedback means generate a signal upon the infrared signal means indicating the receipt of an infrared transmission signal;

whereby the base has a cavity defined therein with electrical contacts integrally formed and positioned medially within the cavity, and whereby the feedback means comprises a cable having a vibratory pad affixed at a first end and connection means to mate with the electrical contacts affixed at a second end.

2. The device as set forth in claim 1, whereby the infrared signal acquisition means comprises one or more photo sensors affixed to a circuit board mounted inside the cover.

3. The device as set forth in claim 1, whereby the electronic circuit board comprises a function switch portion and a mode switch portion.

4. The device as set forth in claim 3, whereby the emitter sources are light emitting diodes.

5. The device as set forth in claim 3, whereby the emitter sources are infrared emitters.

6. The device as set forth in claim 5, further comprising a function switch retainer having a first integral capture and detent means, a second integral capture and detent means and a third integral capture and detent means, and further whereby positioning of the function switch in the first integral capture and detent means actuates a first function of the system for a selected operating mode and the positioning of the function switch in either the second integral capture and detent means or third integral capture and detent means actuates a second function of the system for a selected operating mode.

7. The device as set forth in claim 6, further comprising one or more vibration motors in electrical communication with the electronic circuit board mounted in the base.

8. The device as set forth in claim 7, further comprising an operating status switch in electrical communication with the electronic circuit board, whereby the operating status switch activates one or more of the vibration motors to signal a user as to the activity state of the device.

9. A mountable mufti-function light device, comprising in combination:

a cover formed of material permitting passage of light having an outer surface portion;

a base having an upper surface, a lower surface, a top perimeter edge and fastening means affixed to the lower surface;

an electronic circuit board;

a first switching means for selectively choosing function positions mounted to the cover and being in electrical communication with the electronic circuit board;

a second switching means for selectively choosing operating modes mounted to the cover and being in electrical communication with the electronic circuit board;

at least one emitter source mounted on the electronic circuit board and being in electrical communication with the electronic circuit board;

infrared signal acquisition means for receiving incoming infrared transmission signals;

feedback means for user of device in electrical communication with the infrared signal acquisition means;

a battery as a power source being in communication with the electronic circuit board; and an operating status switch in electrical communication with the electronic circuit board, whereby the operating status switch activates one or more of the vibration motors to signal a user as to the activity state of the device.

10. The device as set forth in claim 9, further comprising one or more vibration motors in electrical communication with the electronic circuit board mounted in the base.

11. A mountable mufti-function light device, comprising in combination:

a cover formed of material permitting passage of light having an outer surface portion;

a base having an upper surface, a lower surface, a top perimeter edge and fastening means affixed to the lower surface;

an electronic circuit board;

a first switching means for selectively choosing function positions mounted to the cover and being in electrical communication with the electronic circuit board;

a second switching means for selectively choosing operating modes mounted to the cover and being in electrical communication with the electronic circuit board;

at least one emitter source mounted on the electronic circuit board and being in electrical communication with the electronic circuit board;

infrared signal acquisition means for receiving infrared transmission signals;

an operating status switch in electrical communication with the electronic circuit board, whereby the operating status switch activates one or more vibration motors to signal a user as to the activity state of the device; and a battery as a power source being in communication with the electronic circuit board.

* * * * *